US005186470A

United States Patent [19]

Easton et al.

[11] Patent Number: 5,186,470

[45] Date of Patent: Feb. 16, 1993

[54] OFFSET ARROW NOCK

[75] Inventors: James L. Easton, Los Angeles; Gary W. Filice, Moorpark, both of Calif.

[73] Assignee: Easton Aluminum, Inc., Van Nuys, Calif.

[21] Appl. No.: 884,439

[22] Filed: May 18, 1992

[51] Int. Cl.[5] ..... F42B 6/06

[52] U.S. Cl. ..... 273/416

[58] Field of Search ..... 273/416

[56] References Cited

U.S. PATENT DOCUMENTS

| | | | |
|---|---|---|---|
| 2,581,884 | 1/1952 | Ringel | 273/416 |
| 3,034,789 | 5/1962 | Moore | 273/416 |
| 3,658,335 | 4/1972 | Saunders | 273/416 |
| 4,134,369 | 1/1979 | Cook | 273/416 X |
| 4,305,588 | 12/1981 | Dodge | 273/416 |
| 4,544,163 | 10/1985 | Scanlon | 273/416 |
| 4,645,211 | 2/1987 | Beiter | 273/416 |
| 4,823,762 | 4/1989 | Pugh | 273/416 X |

*Primary Examiner*—Paul E. Shapiro

*Attorney, Agent, or Firm*—Roth & Goldman

[57] ABSTRACT

An archery arrow nock (10) having a bowstring receiving groove (16) with a string contact point which is offset from the central axis (12) of the arrow to which the nock is to be attached permits the use of a lighter weight less stiff arrow by countering and diminishing the normal bending of the arrowshaft as it is propelled forward by acceleration of the bowstring at the moment of release. The string contact point may be offset either laterally from the plane containing the bowstring and arrow centerline or in this plane away from the arrow centerline.

16 Claims, 2 Drawing Sheets

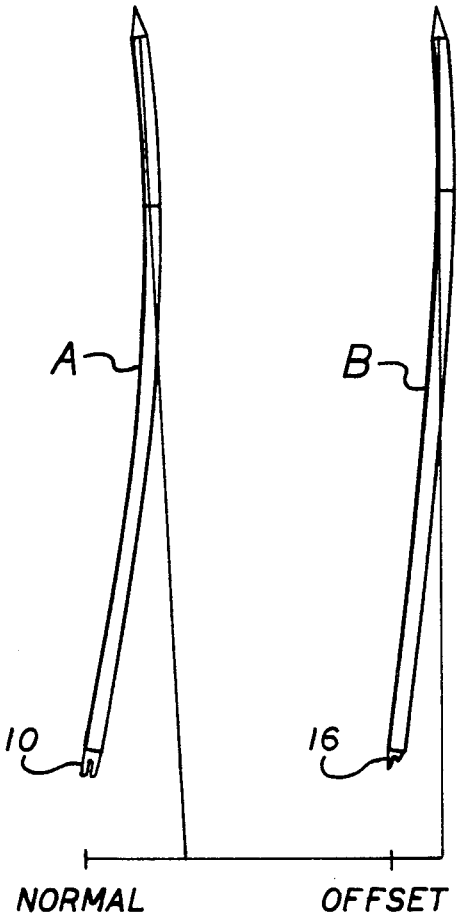
FIG. 3
FIG. 5
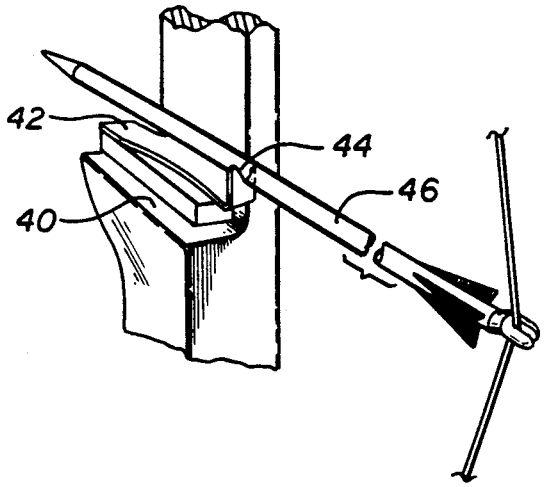
FIG. 6
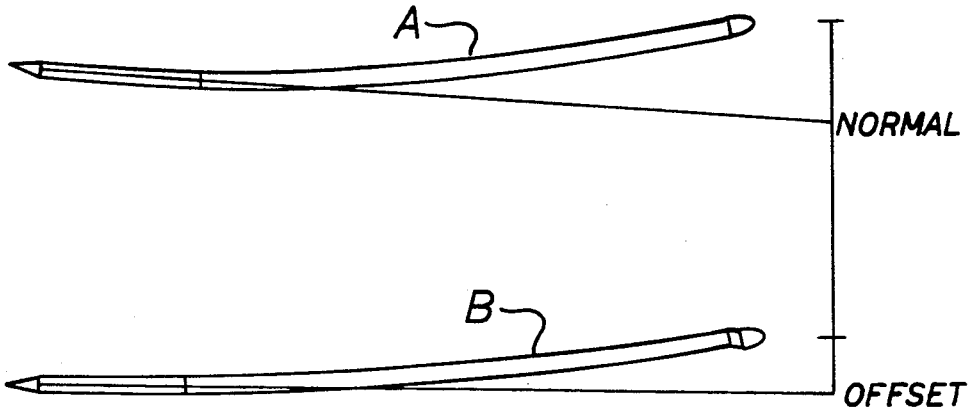

OFFSET ARROW NOCK

BACKGROUND OF THE INVENTION AND PRIOR ART

1. Field of the Invention

This invention relates in general to archery arrows and, more particularly, to arrow nocks affixed to the arrows which receive the bowstring.

2. Prior Art

Arrow nock configurations in which the bowstring receiving groove of the nock and the bowstring contact point in the groove of the nock are each centrally aligned with the arrow centerline so that the force imparted to the nock by the bowstring is centrally imparted to the arrow are conventional. Arrows selected by the archer are matched both to the weight of the bow and to the length of the draw. The load imparted to the arrow by the bowstring at release and the contact between the arrow and the arrowrest on the bow result in substantial natural deflection of the arrow. This flexing of the arrow continues far beyond the point where the arrow leaves the string such that, as the vanes pass the arrowrest, an arrow with the proper stiffness is flexed just far enough away from the arrowrest so the vanes do not strike it. This is called proper clearance. Choosing the correct stiffness of the arrow so that the vanes are flexed as far away as possible from the arrowrest as they pass the bow depends on the force of the bow and the length of the arrow. In a conventional arrow, the arrow stiffness must be increased to withstand the load of a heavier bow. A stiffer arrow is heavier and slower than a less stiff arrow.

The objective of the invention is to duplicate the deflection of a conventional arrow with a less stiff, lighter arrow. This is done by counteracting some of the natural deflection of the less stiff, lighter arrow by applying the load form the string at the appropriate distance (offset) from the centerline of the arrow.

SUMMARY OF THE INVENTION

Although it is generally known that arrows flex when propelled by the bowstring, it is not readily appreciated that such flexing can be minimized by proper design of the nock.

The present invention accordingly provides an arrow nock having a first axis which is to be aligned with the centerline of an arrow, an arrow connecting end which is substantially centered on said axis, a second axis parallel to said first axis and a bowstring receiving groove opening away from said arrow receiving end, said groove having a string contact point on said second axis, said second axis being spaced a selected distance from said first axis.

The present invention further provides an archery arrow comprising a shaft having a central axis and an arrow nock affixed thereto, said nock having a first axis aligned with the centerline of said arrow, an end connected to said arrow substantially centered on said axis, a second axis parallel to said first axis and a bowstring receiving groove, said groove having a string contact point on said second axis, said second axis being spaced a selected distance from said first axis.

BRIEF DESCRIPTION OF THE DRAWINGS

FIG. 3 is a plan view comparatively showing flexing displacement in a horizontal plane of arrows with and without a laterally offset grove as seen in the embodiments of FIG. 2 which have been shot by a recurve bow.

FIG. 5 is a partial perspective of an arrow being shot by a bow having a vertical launcher rest used when the archer uses a mechanical string release device.

FIG. 6 is an elevation view of flexing displacement in a vertical plane of arrows with and without a parallel offset string contact point as seen in the nocks of FIG. 4 which have been shot by a bow having a vertical launcher rest and spring.

DESCRIPTION OF THE PREFERRED EMBODIMENTS

Figure 1A:
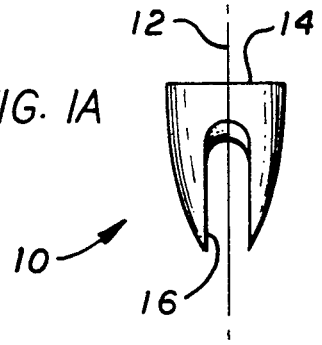
FIGS. 1A and 1B are plan and side views of a typical prior art arrow nock with a centrally located bowstring receiving groove.
Figure 1B:
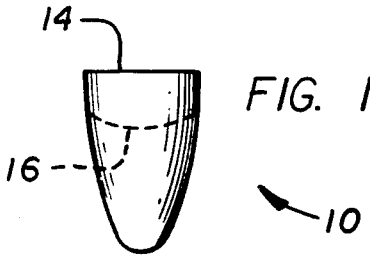

FIGS. 1A and 1B show an ordinary prior art arrow nock 10, typically made of plastic having a central axis 12, a flat arrow receiving end 14 to which the arrow is to be cemented or otherwise attached and a bowstring receiving groove 16 disposed in the plane occupied by a bowstring (not shown) aligned with the axis 12 of the nock.

FIGS. 2A through 2D respectively show plan views of a number of different embodiments of arrow nocks constructed according to the teachings of the present invention with the bowstring receiving grooves 16 being laterally offset a distance X from a plane parallel to the groove which contains the central axis 12 of the arrow to be attached to the arrow receiving end 14 of the nock.

Figure 2A:
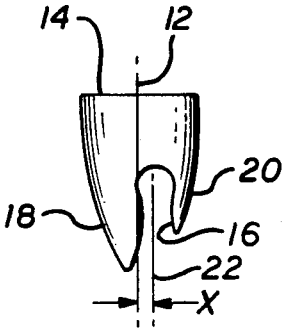
FIGS. 2A–2D are plan views of various embodiments of arrow nocks in which the plane which bisects the bowstring receiving groove is laterally offset from a parallel plane which extends through the centerline of the arrow.

In FIG. 2A an arrow nock has a bowstring receiving groove 16 defined by a pair of spaced legs 18, 20 of unequal length. The nock has a central axis 12 and the groove 16 is bisected by a plane 22 which is slightly offset from the axis 12 a displacement X which may be in the range of from 0.015 inches to 0.060 inches.

Figure 2B:
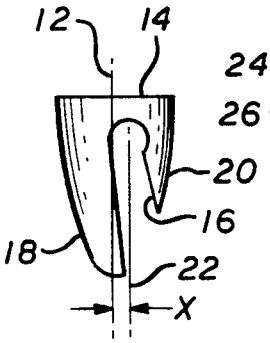

FIG. 2B shows a configuration slightly different from that shown in FIG. 2A wherein it can be seen that the tail end of the longer 18 of the two legs 18, 20 of the nock which defines the bowstring receiving groove 16 extends slightly across the axis 12 toward the plane 22 to facilitate an angled exit of the bowstring from the groove.

Figure 2C:
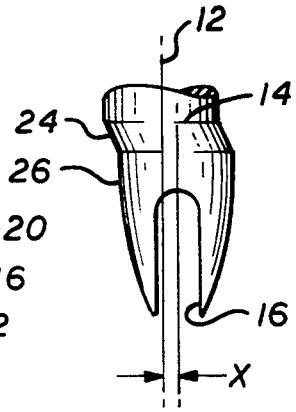

FIG. 2C shows a third embodiment of the invention in which the nock has a first portion 24 having an end 14 centered around axis 12 to be aligned with the centerline of the arrow and a second or body portion 26 which is laterally offset from the first portion 24. The bowstring receiving groove 16 is centered on the plane 22 which also bisects the second portion 26 of the nock.

Figure 2D:
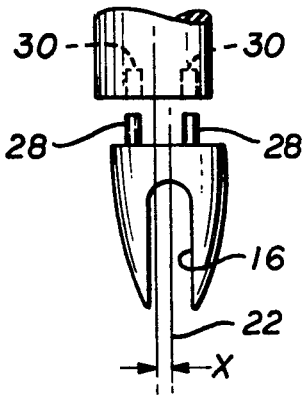

FIG. 2D shows a fourth embodiment of the invention which is provided with a plurality of arrow connecting plugs 28 which are received in holes 30 in the end of the arrow shaft. The plugs 28, which may be two or three in number, are preferably centered around axis 12 which is conveniently located a select offset distance X from the central plane 22 of the nock so that the plugs, when inserted in complimentary holes in the end of the arrow shaft, will properly position the nock such that the groove 16 therein is laterally offset from the centerline of the arrow.

FIG. 3 shows the curvature or flexing of arrows shot by a conventional recurve bow held in a vertical plane. The arrow A shown in the "Normal" portion of the figure is constructed with a conventional nock 10 having a centrally disposed bowstring receiving groove and the arrow B shown in the "Offset" portion of the figure has been provided with a nock having a bowstring receiving groove 16 which has been laterally offset to the right from the arrow centerline according to the teachings of the present invention. A right handed archer will ordinarily wish to position the lateral offset to the right of the arrow to compensate for slight transverse movement of the bowstring during finger release and for contact of the arrow with the bow during shooting which causes significant flexure of the arrow A which has a conventional nock. Left handed shooters using left handed bows will ordinarily position the arrow just the opposite; however, each archer will position the offset to obtain the best results based upon his personal experience.

The bending of the arrows has been exaggerated for clarity to show that arrows B provided with offset nocks of the present invention curve or flex considerably less under columnar loading imparted by the bowstring than prior art arrows. This offset permits the use of a weaker stiffness lighter weight arrow, thus allowing greater velocity, flatter shooting trajectory, and less chance of flight deviation for more accurate shooting.

Figure 4A:
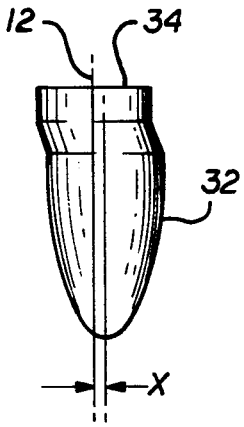
FIGS. 4A–4D are side and plan views of two different embodiments of arrow nocks respectively having an offset of the string groove or the string contacting part of the groove from the arrow centerline in the plane which bisects the bowstring groove.
Figure 4B:
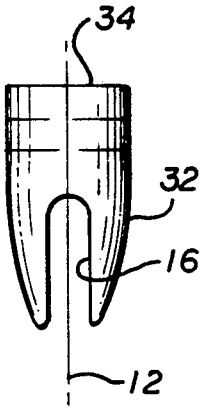

FIGS. 4A and 4B respectively show side and plan views of one embodiment of an arrow nock in which the groove is offset from the arrow centerline a distance X in the same plane as the bowstring (vertically for a conventional bow). The string groove 16 is centered on the plane 22 but the body portion 32 of the nock containing the string groove is offset in that plane from the centerline 12 of the arrow attachment end 34 of the nock.

Figure 4C:
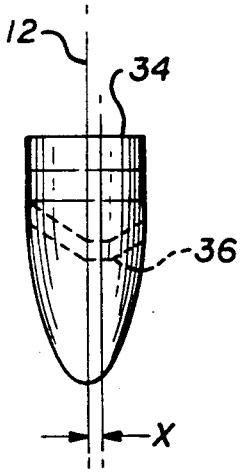
Figure 4D:
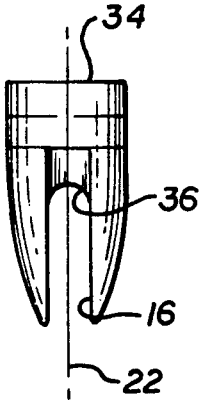

FIGS. 4C and 4D respectively show side and plan views of a modified embodiment in which the string contact point 36 of the string receiving groove 16, but not the body portion of the nock which contains it, is offset in the plane 22 from the center axis 12 of the arrow attachment end 34 of the nock similar to the embodiment of FIGS. 4A and 4B.

FIG. 5 shows a partial perspective of a bow having a vertical launcher rest 40 and shot with a mechanical string release device (not shown) which eliminates the flex of the arrow and in which the bow is equipped with a leaf spring member 42 having a cleft 44 in which the arrow 46 rests during shooting. The leaf spring imparts a slight vertical component of motion to the arrow during shooting as is known in the art but the two sides of the V portion of the cleft substantially equalize horizontal bow contact forces imparted to the arrow during shooting. The embodiments of the nock shown in FIG. 4 which have groove offset in the plane of the bowstring are primarily intended for use with bows having a vertical launcher rest provided with a spring 42 and shot with a mechanical release device. The archer uses a nock as described with reference to the embodiments of FIG. 4 and positions the offset upwardly of the arrow centerline to compensate for vertical forces imparted to the arrow by the spring 42.

FIG. 6 shows bending in a vertical plane of conventional arrows and arrows having a parallel offset nock as shown in FIG. 4 shot by a recurve bow provided with a vertical launcher rest 40 and spring 42 shown in FIG. 5. The "Normal" portion of the figure shows a greater flex or bending curvature when the arrow A has a centrally located bowstring receiving groove and considerably less flexing or curvature in the "Offset" portion of the figure when the arrow B is provided with a nock having a parallel offset groove as shown in the embodiments of FIG. 4.

Although the invention has been described with primary reference to a recurve bow, the teachings are also applicable to arrows for crossbows and the like. Persons skilled in the art will readily appreciate that various modifications can be made from the preferred embodiment thus the scope of protection is intended to be defined only by the limitations of the appended claims in which reference numerals have been included merely for explanation rather than limitation.

We claim:

1. An arrow nock having a first axis which is to be positioned coaxially with the centerline of an arrow, an arrow connecting end which is substantially centered on said first axis, a second axis parallel to said first axis, said second axis being spaced from said first axis by a distance in the range of from 0.010" to 0.060", and a bowstring receiving groove opening away from said arrow receiving end, said groove being centered on a plane (FIG. 2A–2D) containing said second axis laterally spaced from and parallel to a plane containing said first axis.

2. The arrow nock of claim 1, wherein said groove is located and laterally offset in a portion of the nock which is centrally aligned with said arrow receiving end (FIGS. 2A, 2B).

3. The arrow nock of claim 1, wherein said groove is centrally located in a portion of the nock (FIG. 2C) which is laterally offset from said arrow receiving end.

4. The arrow nock of claim 1, wherein said groove is defined by a pair of legs extending on opposite sides of said groove, said legs being of unequal length (FIGS. 2A and 2B).

5. The arrow nock of claim 4, wherein the shorter of said legs is laterally displaced further from said first axis than the longer one of said legs (FIG. 2A).

6. An arrow nock having a first axis which is to be positioned coaxially with the centerline of an arrow, an arrow connecting end which is substantially centered on said first axis, a second axis parallel to said first axis, said second axis being spaced rom said first axis by a distance in the range of from 0.010" to 0.060", and a bowstring receiving groove opening away from said arrow receiving end, said groove being bisected by a plane, between the sides of the grooves containing said first axis (FIGS. 4A–4D) and said groove having a string contact area centered on a point which is offset in said plane a distance of from 0.010" to 0.060" from said first axis.

7. The arrow nock of claim 6, wherein said groove is located in a portion of the nock which is offset from the arrow receiving end of the nock (FIG. 4A, 4B).

8. The arrow nock of claim 6, wherein said groove is in a portion of the nock which is aligned with the arrow connecting end of the nock (FIGS. 4C, 4D).

9. An archery arrow comprising a shaft having a central axis and an arrow nock affixed thereto, said nock having a first axis coaxial with the centerline of said arrow, an end connected to said arrow substantially centered on said first axis, a second axis parallel to said first axis, said second axis being spaced from said first axis by a distance in the range of from 0.010" to 0.060", and a bowstring receiving groove, said groove being centered on a plane (FIGS. 2A–2D) containing said second axis laterally spaced from and parallel to a plane containing said first axis.

10. The arrow of claim 9, wherein said groove is laterally offset in a portion of the nock which is centrally coaxial with said arrow shaft.

11. The arrow of claim 9, wherein said groove is centrally located in a portion of the nock which is laterally offset from said arrow shaft.

12. The arrow of claim 9, wherein said groove is defined by a pair of legs extending on opposite sides of said groove, said legs being of unequal length.

13. The arrow of claim 12, wherein the shorter of said legs is laterally displaced further from said first axis than the longer of said legs.

14. An archery arrow comprising a shaft having a central axis and an arrow nock affixed thereto, said nock having an arrow connecting end which is substantially centered on said first axis, a second axis parallel to said first axis, and a bowstring receiving groove opening away from said arrow receiving end, said groove being bisected by a plane, between the side of the groove containing said first axis (FIGS. 4A–4D) and said groove having a string contact area centered on said second axis, said second axis being offset in said plane a distance of from 0.010" to 0.060" from said first axis.

15. The arrow of claim 14, wherein said groove is centrally located in a portion of the nock which is laterally offset from said arrow shaft (FIG. 4A–4B).

16. The arrow of claim 14, wherein said groove is defined by a pair of legs extending on opposite sides of said groove, said legs being of unequal length.

* * * * *